US011206471B1

(12) United States Patent
Seo et al.

(10) Patent No.: US 11,206,471 B1
(45) Date of Patent: Dec. 21, 2021

(54) EARPHONE WITH PRESSURE EQUILIBRIUM MEANS

(71) Applicant: BUJEON CO., LTD., Ansan-si (KR)

(72) Inventors: Donghyun Seo, Ansan-si (KR); Minkoo Park, Hwaseong-si (KR); Halim Kim, Ansan-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/340,389

(22) PCT Filed: Mar. 11, 2019

(86) PCT No.: PCT/KR2019/002802
§ 371 (c)(1),
(2) Date: Oct. 18, 2021

(87) PCT Pub. No.: WO2019/177324
PCT Pub. Date: Sep. 19, 2019

(30) Foreign Application Priority Data

Mar. 12, 2018 (KR) ..... 10-2018-0028625

(51) Int. Cl.
*H04R 1/10* (2006.01)
*H04R 9/06* (2006.01)
*H04R 9/02* (2006.01)

(52) U.S. Cl.
CPC ..... *H04R 1/1016* (2013.01); *H04R 9/025* (2013.01); *H04R 9/06* (2013.01); *H04R 2460/11* (2013.01)

(58) Field of Classification Search
USPC ..... 381/309, 328, 348, 151, 380, 381
See application file for complete search history.

(56) References Cited

U.S. PATENT DOCUMENTS 9,949,048 B2 * 4/2018 Isberg ..... G06F 3/162

FOREIGN PATENT DOCUMENTS

| | | | | |
|---|---|---|---|---|
| KR | 10-0550972 B1 | | 2/2006 | |
| KR | 20-0408511 Y1 | | 2/2006 | |
| KR | 2020050033231 | * | 2/2006 | ..... H04B 1/38 |
| KR | 10-1440144 B1 | | 9/2014 | |
| KR | 10-1461188 B1 | | 11/2014 | |
| KR | 10-1558091 B1 | | 10/2015 | |
| KR | 10-2017-0139320 A | | 12/2017 | |
| KR | 1020170139320 | * | 12/2017 | ..... H04R 7/08 |

* cited by examiner

*Primary Examiner* — Yosef K Laekemariam
(74) *Attorney, Agent, or Firm* — KORUS Patent, LLC; Seong Il Jeong

(57) ABSTRACT

The present invention relates to an earphone equipped with a pressure equalizing means, and more specifically to an earphone equipped with a pressure equalizing means, in which a speaker unit is disposed inside an earphone housing in a longitudinal direction and a first air path is formed to discharge sound waves, generated by the diaphragm of the speaker unit, to the external ear canal through one side of the speaker unit. When air inside the external ear canal is discharged out of the speaker unit, air is discharged into the vibration space of the speaker unit by using the first air path, and is then discharged out of the speaker unit through a second air path formed in the other side of the top surface of the speaker unit.

10 Claims, 7 Drawing Sheets

EARPHONE WITH PRESSURE EQUILIBRIUM MEANS

TECHNICAL FIELD

The present invention relates to an earphone equipped with a pressure equalizing means, and more specifically to an earphone equipped with a pressure equalizing means, in which a speaker unit is disposed inside an earphone housing in a lateral direction so that sound waves generated by the diaphragm of the speaker unit may be emitted to the external ear canal through one side of the speaker unit, and in which air inside the external ear canal is discharged out of the speaker unit through first and second air paths formed in one side and top surface of the speaker unit, respectively, so that the structure of a pressure equalizing means may be simplified.

BACKGROUND ART

Earphones are devices that convert electric energy into acoustic energy, and enable sound to be heard by transferring vibration to the eardrums of the external ear canals without emitting the sound to space. Earphones are widely used in portable audio devices, such as mobile phones and MP3 players, because sound is directly transmitted to the ears of a user and thus they enable sound to be heard even at low power and because they do not damage surroundings.

In particular, canal-type earphones have the advantage of being able to be used in a noisy place because they have a desirable sound insulation property, but a pressure difference may occur because the ears of a user are completely blocked from the outside. Meanwhile, this pressure difference may damage the ears of the user. For example, when the diaphragm of a speaker unit vibrates in a state in which air in the external ear canals of the user cannot be discharged to the outside, the pressure in the external ear canals increases gradually and thus the pressure difference becomes larger. This pressure difference applies pressure to the eardrums of the external ear canals, and thus sound cannot be appropriately heard or the eardrums may be damaged in the worst case.

In order to overcome this problem, conventional canal-type earphones prevent a pressure difference from occurring in such a manner that air inside the external ear canals is discharged to the outside by forming ventilation grooves on the inner surfaces of earpieces coupled to sound tubes or by forming ventilation holes in the sound tubes to which the earpieces are coupled. However, there is concern that the ventilation grooves formed on the earpieces or the ventilation holes are blocked by the earpieces when the earpieces are inserted into the external ear canals. Furthermore, the air paths of the conventional ventilation grooves or ventilation holes have short lengths and air inside the sound tubes is directly discharged to the outside, and thus a problem arises in that it is difficult to precisely control the amount of air to be discharged.

Therefore, Korean Patent No. 10-1558091 discloses a "canal-type earphone equipped with a pressure equalizing means," the earphone including a pressure equalizing means 40 configured to discharge air inside a sound tube 25 or air inside a speaker unit 10 (between a cover and a diaphragm) to a location behind the speaker unit 10, wherein the pressure equalizing means 40 includes a side air path 50 configured to discharge air inside the sound tube 25 or air inside the speaker unit 10 through a side surface of the speaker unit 10 and a rear air path 60 configured to discharge air on the side surface of the speaker unit to a location behind the speaker unit 10.

This conventional technology is intended to achieve pressure equalization in such a manner that air inside the sound tube or air inside the speaker unit is discharged to a location behind the speaker unit through the side air path 50 formed through the front surface of the speaker unit 10 and the rear air path 60 formed through the side surface of the speaker unit 10. In particular, an advantage arises in that the amount of air to be discharged may be precisely controlled because the air path of the pressure equalizing means 40 is long and the direction of the air path is bent at an angle of 90 degrees.

However, this conventional technology requires that a through groove be formed in a gasket 30 disposed on the front surface of the cover 18 of the speaker unit 10 in order to form the side air path 50 and a through groove be formed between the speaker unit 10 and an earphone housing in order to form the rear air path 60. Accordingly, problems arise in that the work of forming the through grooves in the gasket 30 and the earphone housing 20 is complicated and air does not flow smoothly because the widths of the through grooves formed in the gasket 30 and the earphone housing 20 are limited.

DISCLOSURE

Technical Problem

The present invention has been conceived to overcome the problems of the conventional technology, and a main object of the present invention is to provide an earphone that is equipped with a pressure equalizing means capable of discharging air inside the sound tube of the earphone and air inside a speaker unit out of the speaker unit and that enables air paths to have simplified structures and to have increased lengths and widths, thereby enabling the amount of air, which will be discharged, to be minutely controlled.

Technical Solution

In order to accomplish the above object, the present invention provides an earphone equipped with a pressure equalizing means, the earphone including:

an earphone housing in which a sound tube has been formed;

a speaker unit which is disposed inside the earphone housing so that one side thereof is directed toward the sound tube;

an ear tip which is fitted over the sound tube;

a first air path which is formed in one side of the speaker unit, and which is formed to emit sound waves, generated by the diaphragm of the speaker unit, toward the sound tube; and a second air path which is formed in the top surface of the speaker case surrounding the speaker unit, and which is formed to discharge air, inside a vibration space between the speaker case and the diaphragm, out of the speaker unit;

wherein the pressure equalizing means discharges air inside the sound tube out of the speaker unit through the first air path, the vibration space of the speaker unit, and the second air path.

In the present invention, the earphone housing may be configured such that the sound tube protrudes from the front surface of the earphone housing, a hollow formed to communicate with the sound tube is formed inside the earphone housing in a front-back direction, a coupling portion having an increased diameter so that the speaker unit is inserted thereinto is formed in the center portion of the hollow, a resonant portion configured to receive the speaker unit is formed behind the hollow, and the resonant portion communicates with an outside air through a through hole formed in the rear end of the earphone housing.

The speaker unit may be disposed in the hollow of the earphone housing in a longitudinal direction, and may be disposed such that the front end portion thereof is fastened to the coupling portion and the rear end portion thereof is located within the resonant portion.

The speaker unit may include: a speaker case in which an upper case and a lower case are vertically coupled to each other, and inside which a predetermined space is formed; a magnetic circuit member which includes a yoke, a magnet, and an upper plate which are disposed inside the speaker case; a fastening ring which is disposed on the top surface of the upper plate; a diaphragm the edge of which is disposed on the top of the fastening ring; and a grill which fastens the edge of the diaphragm.

The yoke may include a column portion vertically formed at a center of the yoke and provided with a vertical hollow and a flange portion extended outward from a lower end of the column portion by a predetermined length and formed in a rectangular shape so that the yoke is accommodated inside the lower case, the magnet may be formed in a rectangular ring shape that is spaced apart from the column portion of the yoke by a predetermined distance, an evasion groove may be formed to a predetermined depth through the top surface of the upper plate disposed on the top surface of the magnet so that the lead wire of a voice coil passes through the upper plate, and a seat portion configured to allow a fastening ring to be seated thereon may be formed to a predetermined depth along the edge of the top surface of the upper plate.

The first air path may include an inner opening formed in one side of the grill and an outer opening formed in one side of the upper case to correspond to the inner opening.

The second air path may include an inner through hole formed in the other side of the top surface of the grill and an outer through hole formed in the other side of the top surface of the upper case to correspond to the inner through hole.

A screen damper configured to control the amount of air may be disposed above the outer through hole of the second air path.

The speaker unit may include: a speaker case in which an upper case and a lower case are vertically coupled to each other, and inside which a predetermined space is formed; a coil which is disposed inside the speaker case, and which generates a magnetic field due to current; an armature which is magnetized by the magnetic field generated due to the current which flows along the coil; a magnet which generates a magnetic field to interact with the magnetized armature; a drive rod which is coupled perpendicular to the armature; and a diaphragm which is vibrated by the drive rod coupled to the armature and generates sound.

The first air path may include an outer opening formed in one side of the upper case to correspond to the inner opening, the second air path may include an outer through hole formed in the other side of the top surface of the upper case to correspond to the inner through hole, and the first air path and the second air path may communicate with each other through the vibration space formed between the upper case and the diaphragm.

Advantageous Effects

As described above, the earphone equipped with a pressure equalizing means having a simple structure according to the present invention is configured such that the earphone includes a pressure equalizing means configured to discharge air inside the sound tube of the earphone out of the speaker unit and thus prevents pressure within the external ear canal from increasing, thereby preventing sound from being heard wrong and also preventing an eardrum from being damaged.

Furthermore, the earphone equipped with a pressure equalizing means according to the present invention is configured such that the speaker unit is disposed inside the earphone housing in a longitudinal direction and the first air path formed in one side surface of the speaker unit so that sound generated by the diaphragm of the speaker unit is discharged toward the sound tube is used as a part of the pressure equalizing means configured to discharge air inside the sound tube out of the speaker unit, thereby simplifying the structure of the pressure equalizing means.

Moreover, the present invention is configured such that the second air path is formed in the other side of the top surface of the speaker unit to discharge air inside the speaker unit out of the speaker unit and the vibration space of the speaker unit is interposed between the first air path and the second air path, thereby increasing the length and width of the air path and thus enabling air to flow smoothly.

MODE FOR INVENTION

The present invention will be described in detail below with reference to the accompanying drawings.

Figure 1:
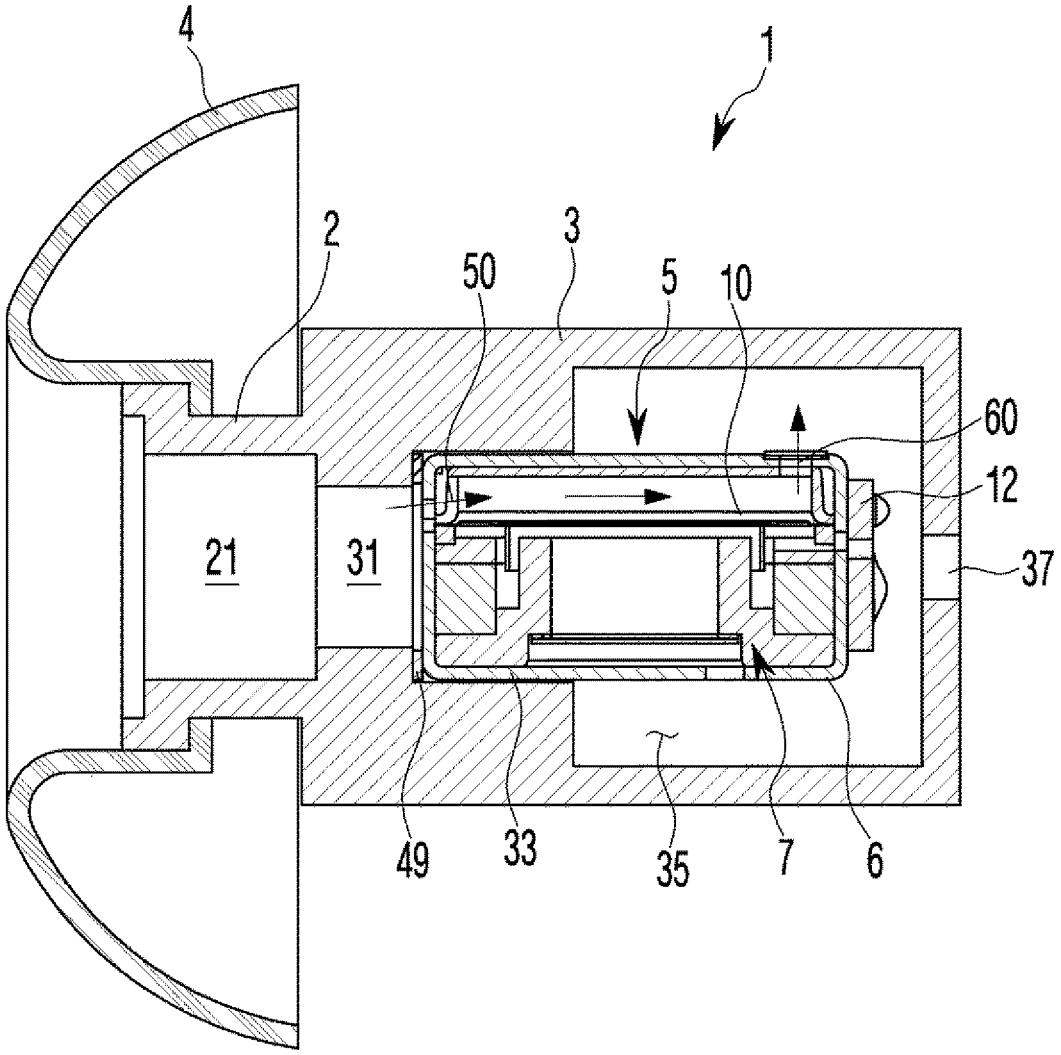
FIG. 1 is a sectional view showing one embodiment of an earphone equipped with a pressure equalizing means according to the present invention.
Figure 2:
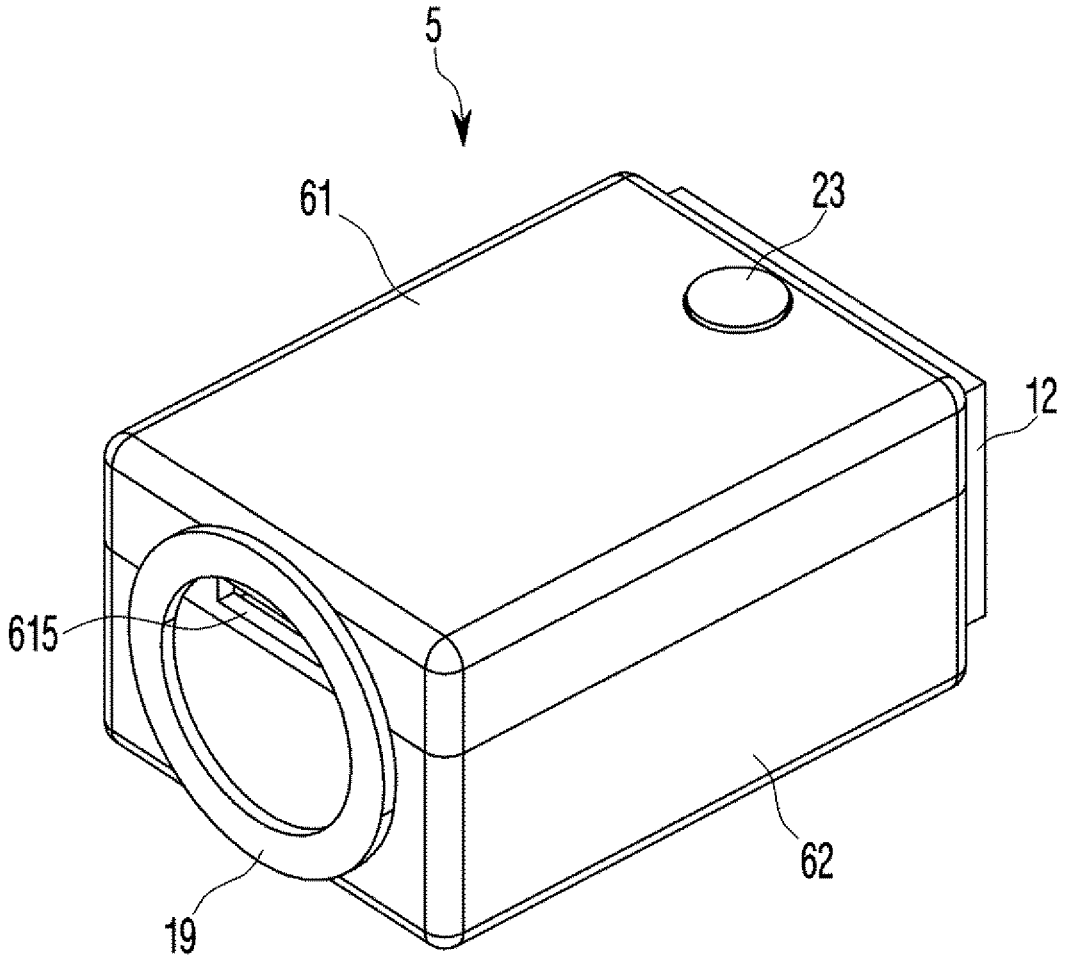
FIG. 2 is a perspective view showing one embodiment of a speaker unit disposed in the earphone equipped with a pressure equalizing means.
Figure 3:
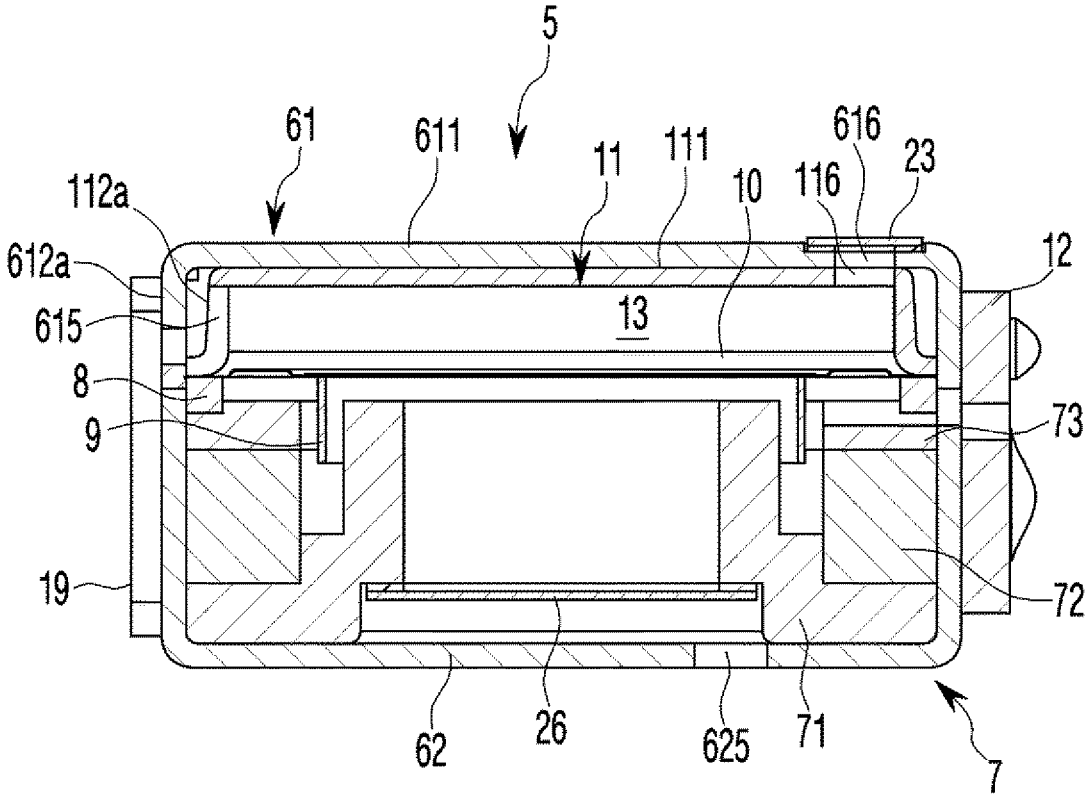
FIG. 3 is a sectional view of the speaker unit shown in FIG. 2.
Figure 4:
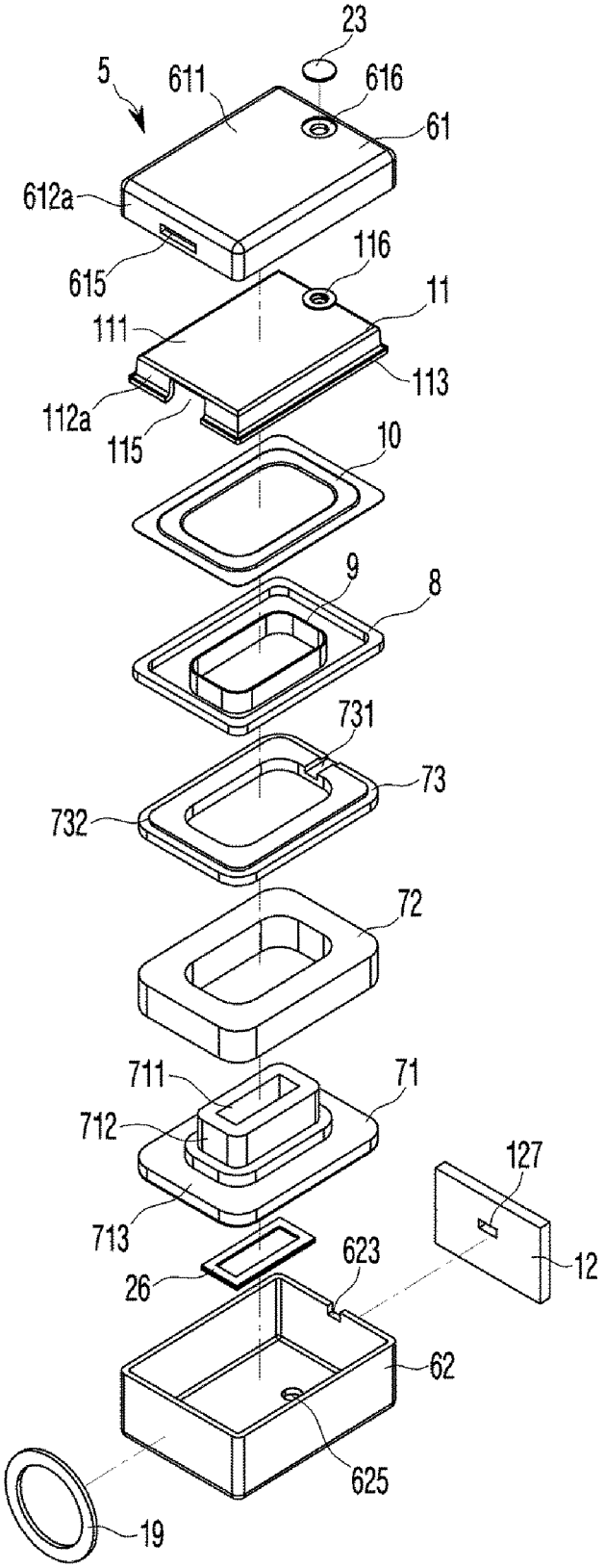
FIG. 4 is an exploded perspective view of the speaker unit shown in FIG. 2.

FIG. 1 is a sectional view of an earphone equipped with a pressure equalizing means according to the present invention, FIG. 2 is a perspective view showing one embodiment of a speaker unit provided in the earphone equipped with a pressure equalizing means, FIG. 3 is a sectional view of the speaker unit shown in FIG. 2, and FIG. 4 is an exploded perspective view of the speaker unit shown in FIG. 2.

As shown in the drawings, an earphone equipped with a pressure equalizing means 1 according to the present invention basically includes: an earphone housing 3 in which a sound tube 2 has been formed; a speaker unit 5 which is disposed inside the earphone housing 3 to emit sound waves toward the sound tube 2; and an ear tip 4 which is fitted over the outer circumference of the sound tube 2.

In particular, the speaker unit 5 of the present invention includes: a first air path 50 which is formed in one side of the speaker unit 5 to emit sound waves, generated by the vibration of a diaphragm 10, toward the sound tube 2; and a second air path 60 which is formed to discharge air, inside a vibration space 13 between a speaker case 6 surrounding the speaker unit 5 and the diaphragm 10, out of the speaker unit 5.

Accordingly, air inside the sound tube 2 may be discharged out of the speaker unit 5 through the first air path 50 formed in the one side of the speaker unit 5 and the second air path 60 formed in the top surface of the speaker unit 5. In other words, the present invention includes a pressure equalizing means 40 which includes the first air path 50 formed in the one side of the speaker unit 5 and the second air path 60 formed in the top surface of the speaker unit 5.

More specifically, the earphone housing 3 is formed in a cylindrical shape, and the sound tube 2 protrudes from the front surface of the earphone housing 3. Furthermore, a hollow 31 formed to communicate with the inside 21 of the sound tube 2 is formed inside the earphone housing 3. Furthermore, a protrusion is formed along the outer circumference of the sound tube 2 in order to fasten the ear tip 4.

Furthermore, a coupling portion 33 configured such that the speaker unit 5 is inserted and fastened thereinto is formed in the center portion of the earphone housing 3. The coupling portion 33 has a diameter larger than that of the hollow 31, and receives the front end portion of the speaker unit 5. Furthermore, a resonant portion 35 configured to receive the speaker unit 5 is formed behind the hollow 31. The resonant portion 35 has a diameter larger than that of the hollow 31, and forms a space having a predetermined size around the speaker unit 5. Furthermore, the resonant portion 35 communicates with the air through a through hole 37 formed in the rear end of the earphone housing 3.

The speaker unit 5 is disposed inside the earphone housing 3 in a longitudinal direction. In other words, the speaker unit 5 is formed in a box shape having a rectangular longitudinal section. The speaker unit 5 is disposed in such a manner that the front portion thereof is fastened inside the coupling portion 33 and the rear portion thereof is located in the resonant portion 35. In this case, a gasket 19 is disposed on the front of the speaker unit 5. Furthermore, the speaker unit 5 is disposed such that sound waves generated by the diaphragm 10 are emitted toward the sound tube 2 through one side of the speaker unit 5.

In other words, the earphone according to the conventional technology is disclosed such that sound waves generated by the diaphragm of the speaker unit are discharged from the top of the diaphragm to the sound tube. Meanwhile, the speaker unit generally has a large width. Accordingly, when the speaker unit is disposed using the conventional method, a problem arises in that the size of the earphone housing increases. Furthermore, a problem occurs in that the structure becomes complicated because it is required that the air paths configured to discharge air inside the sound tube through the gasket disposed on the front surface of the speaker unit and through the side surface of the speaker unit be formed.

The speaker unit 5 is surrounded by the speaker case 6. The speaker case 6 is formed in such a manner that an upper case 61 and a lower case 62 are coupled to each other in a vertical direction. The lower case 62 has an open top and a large depth, and the upper case 61 has an open bottom and a small depth. A sound discharge hole 622 is formed in the bottom of the lower case 62. The sound discharge hole 662 functions to discharge sound pressure and heat, generated inside the speaker case 6, to the outside. Furthermore, a through hole 623 configured to pass the lead wire of a voice coil therethrough is formed in the rear side of the lower case 62.

Furthermore, a magnetic circuit member 7 is disposed inside the lower case 62. The magnetic circuit member 7 includes a yoke 71, a magnet 72, and an upper plate 73. The yoke 71 includes a column portion 712 vertically formed at the center of the yoke 71 and provided with a vertical hollow 711, and a flange portion 713 extended outward from the lower end of the column portion 712 by a predetermined length and formed in a rectangular shape so that the yoke 71 can be accommodated inside the lower case 62. The magnet 72 is formed in a rectangular ring shape to be spaced apart from the column portion 712 of the yoke 71 by a predetermined distance. In other words, a gap is formed between the inner surface of the magnet 72 and the outer surface of the column portion 712. Furthermore, the upper plate 73 is formed as a rectangular ring having a size and shape similar to those of the magnet 72 so that the upper plate 73 is disposed on the top surface of the magnet 72. Preferably, an evasion groove 731 is formed to a predetermined depth through the top surface of the upper plate 73 so that the lead wire of a voice coil passes through the upper plate 73. Furthermore, a seat portion 732 configured to allow a fastening ring, which will be described later, to be seated thereon is formed to a predetermined depth along the edge of the top surface of the upper plate 73.

Accordingly, when the yoke 71, the magnet 72, and the upper plate 73 are sequentially disposed inside the lower case 62, a gap configured to accommodate a voice coil is formed between the magnet 72 and the column portion 712 of the yoke 71. Thereafter, a fastening ring 8 is disposed on the top surface of the upper plate 73. The fastening ring 8 is formed in a rectangular ring shape having a thickness larger than the depth of the seat portion 732 along the edge of the top surface of the upper plate 73. Accordingly, when the fastening ring 8 is disposed on the top surface of the upper plate 73, the top surface of the fastening ring 8 protrudes upward by a predetermined height.

Thereafter, the diaphragm 10 is disposed on the top of the fastening ring 8. The diaphragm 10 is composed of a rectangular plate, and the edge of the diaphragm 10 is located on the top surface of the fastening ring 8. Furthermore, a voice coil 9 is attached to the bottom surface of the diaphragm 10. The voice coil 9 is formed in a container shape having a rectangular section so that the voice coil 9 can be inserted into the gap formed in the magnetic circuit member 7. Furthermore, the lead wire 9*a* of the voice coil 9 is electrically connected to a PCB 12, disposed on an outer surface of the earphone housing 3, through the evasion groove 731 formed in the upper plate 73.

Furthermore, a grill 11 is disposed on the top of the diaphragm 10. The grill 11 extends downward to a predetermined length in order to fasten the edge of the diaphragm 10 by pressing it, thereby forming the vibration space 13 having a predetermined size between the grill 11 and the diaphragm 10 vibrating vertically. In other words, the edge of the top surface 111 of the grill 11 extends downward to a predetermined length to thus form a side surface 112, and the lower end of the side surface 112 extends outward to a predetermined length to thus form a horizontal surface 113.

Furthermore, an inner opening 115 configured to emit sound waves, generated by the vibration of the diaphragm 10, to the outside is formed in one side 111*a* of the grill 11. In this case, the inner opening 115 is formed in the side of the grill 11 that faces the sound tube 2.

Thereafter, the upper case 61 is disposed on the top of the grill 11. The upper case 61 is configured such that the edge of the upper plate 611 extends downward to a predetermined length so that the upper case 61 surrounds the grill 11. In other words, the edge of the top surface 611 of the upper case 16 extends downward to a predetermined length to thus form a side surface 612, and the lower end of the side surface 612 is coupled to the upper end of the lower case 61.

Furthermore, an outer opening 615 is formed in one side 611*a* of the upper case 61 to correspond to the inner opening 115 formed in the grill 11. Accordingly, sound waves generated by the vibration of the diaphragm 10 are emitted to the sound tube 2 through the inner opening 115 of the grill 11 and the outer opening 615 of the upper case 61.

According to the present invention, there is formed the first air path 50 including the inner opening 115 of the grill 11 and the outer opening 615 of the upper case 61. In other words, the first air path 50 functions to discharge sound waves, generated when the diaphragm 10 of the speaker unit 5 vibrates, toward the sound tube 2.

Meanwhile, the speaker unit 5 according to the present invention further includes the pressure equalizing means 40 configured to discharge air inside the sound tube 2 out of the speaker unit 5. In particular, the speaker unit 5 of the present invention is disposed inside the earphone housing 3 in a lateral direction, and thus air in the inside 21 of the sound tube 2 is introduced into the speaker unit 5 through the first air path 50 formed in one side of the speaker unit 5. Furthermore, air inside the speaker unit 5 is discharged out of the speaker unit 5 through the second air path 60 formed in the top surface of the speaker unit 5.

In other words, the pressure equalizing means 40 according to the present invention includes the first air path 50 including the outer opening 615 formed in one side 612*a* of the upper case 61 and the inner opening 115 formed in one side 112*a* of the grill 11 in order to discharge air inside the speaker unit 5 into the sound tube 2. In other words, the first air path 50 functions to discharge sound waves inside the speaker unit 5 to the sound tube 2, and also functions to discharge air inside the sound tube 2 into the vibration space 13 of the speaker unit 5. As described above, the first air path 50 simultaneously performs the two functions, and thus the structure of the pressure equalizing means 40 is simplified.

Furthermore, the pressure equalizing means 40 according to the present invention includes the second air path 60 including an inner through hole 116 formed in the top surface 111 of the grill 11 and an outer through hole 616 formed in the top surface 611 of the upper case 61 to correspond to the inner through hole 116 in order to discharge air inside the vibration space 13 of the speaker unit 5 out of the speaker unit 5.

Accordingly, air inside the sound tube 2 is discharged out of the speaker unit 5 through the first air path 50 and the second air path 60. Furthermore, air discharged into the resonant portion 35 is discharged to the air through the through hole 37. In this case, a screen damper 23 is disposed above the outer through hole 616 of the second air path 60. The screen damper 23 controls the amount of air that is discharged through the outer through hole 616.

Meanwhile, air introduced into the speaker unit 5 through the first air path 50 is moved across the vibration space 13 formed by the grill 11 and the diaphragm 10, and is then discharged through the second air path 60. In other words, the length and widths of the air paths are increased by interposing the vibration space 13 between the first air path 50 and the second air path 60, and thus air may be rapidly discharged, thereby enabling pressure equalization to be easily performed.

As described above, the pressure equalizing means 40 according to the present invention is intended to discharge air inside the sound tube 2 out of the speaker unit 5. First, the pressure equalizing means 40 discharges air into the vibration space 13 of the speaker unit 5 through the first air path 50 including the outer opening 615 formed in the one side 612*a* of the upper case 61 and the inner opening 115 formed in the one side 112*a* of the grill 11 to correspond to the outer opening 615. Furthermore, the air introduced into the vibration space 13 of the speaker unit 5 is moved across the vibration space 13 by a predetermined length in a horizontal direction, and is then discharged out of the speaker unit 5 through the second air path 60, including the inner through hole 116 formed in the top surface 111 of the grill 11 and the outer through hole 616 formed in the top surface 611 of the upper case 61 to correspond to the inner through hole 116, and the screen damper 23 disposed above the outer through hole 616.

Figure 5:
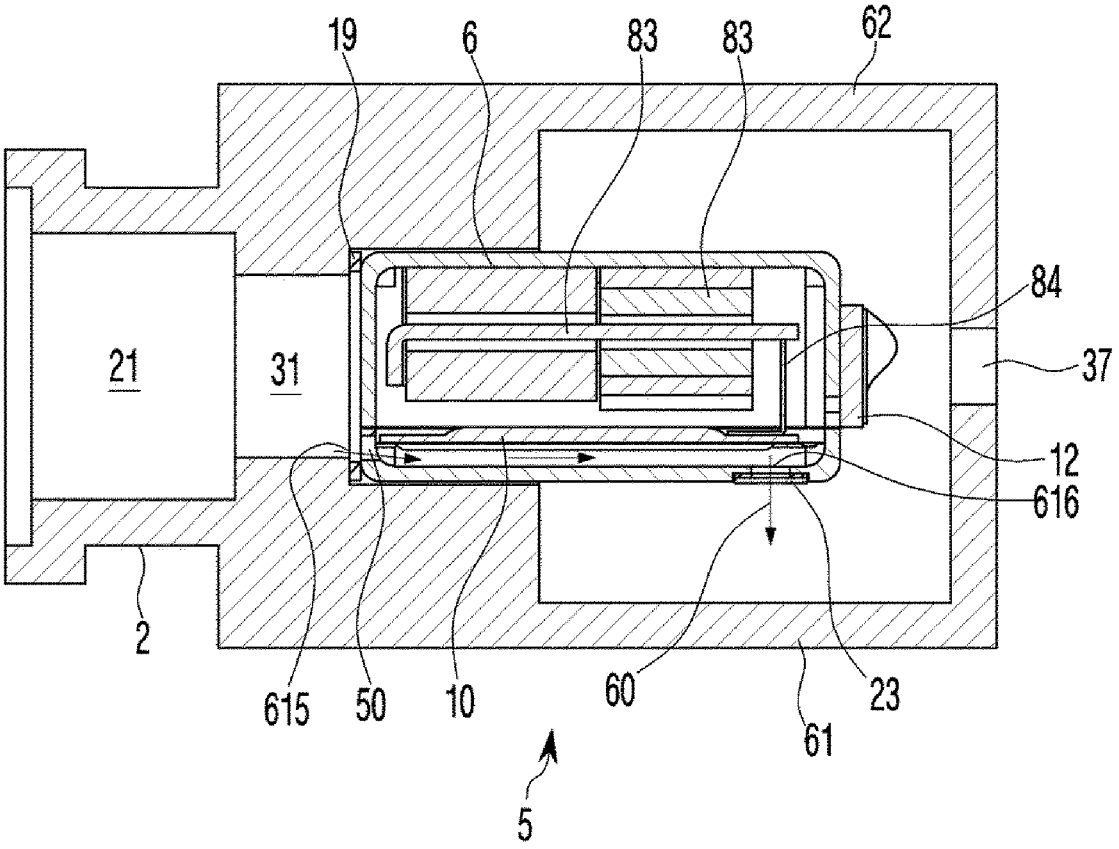
FIG. 5 is a sectional view showing another embodiment of an earphone equipped with a pressure equalizing means according to the present invention.

FIG. 5 is a sectional view showing another embodiment of an earphone equipped with a pressure equalizing means according to the present invention.

As shown in this drawing, the earphone 1 equipped with a pressure equalizing means according to the present embodiment is configured such that an earphone housing 3 has the same structure and a speaker unit 5 has a different structure. In other words, the speaker unit 5 of the present embodiment is a balanced armature unit.

Figure 6:
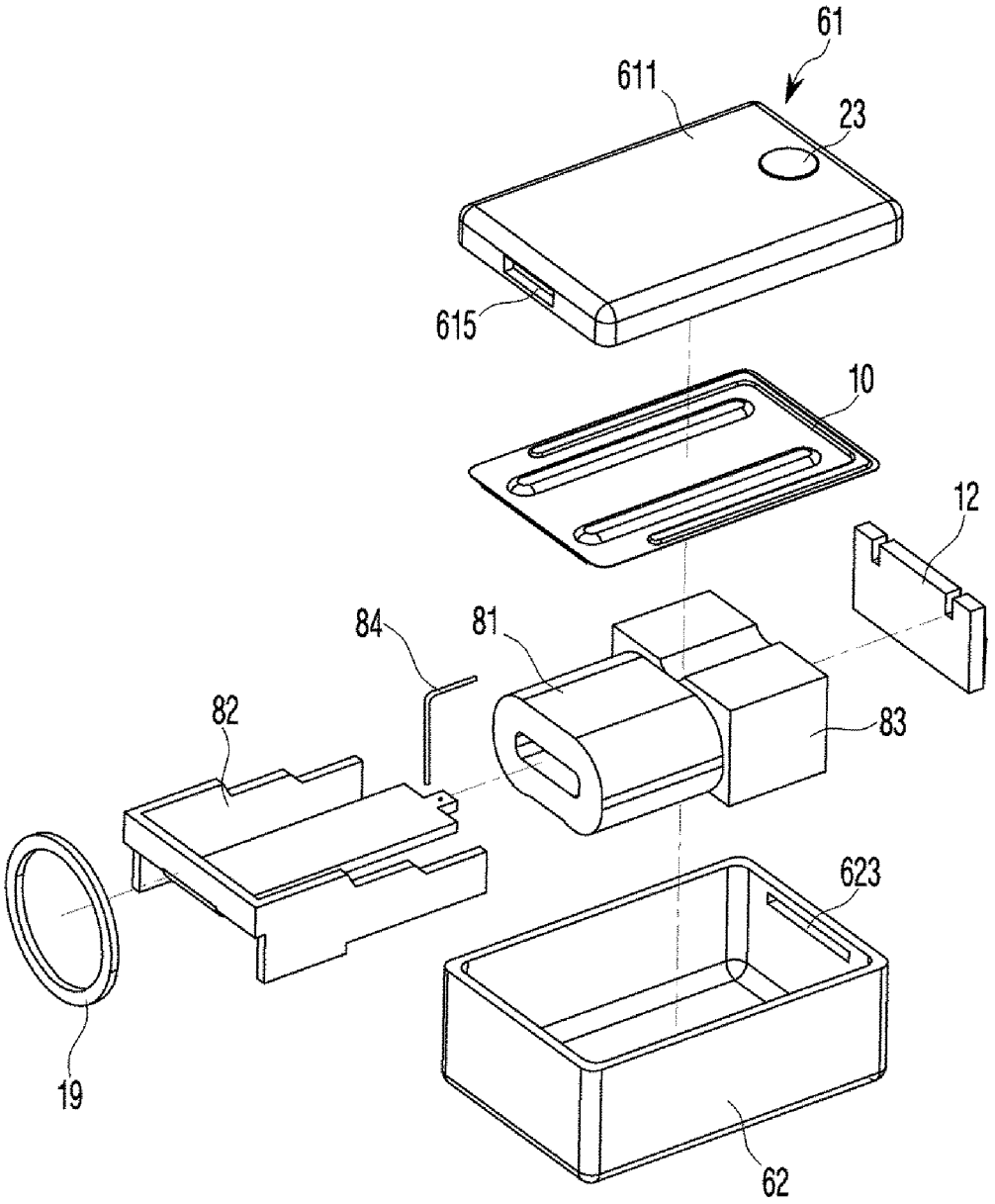
FIG. 6 is an exploded perspective view of the speaker unit shown in FIG. 5.
Figure 7:
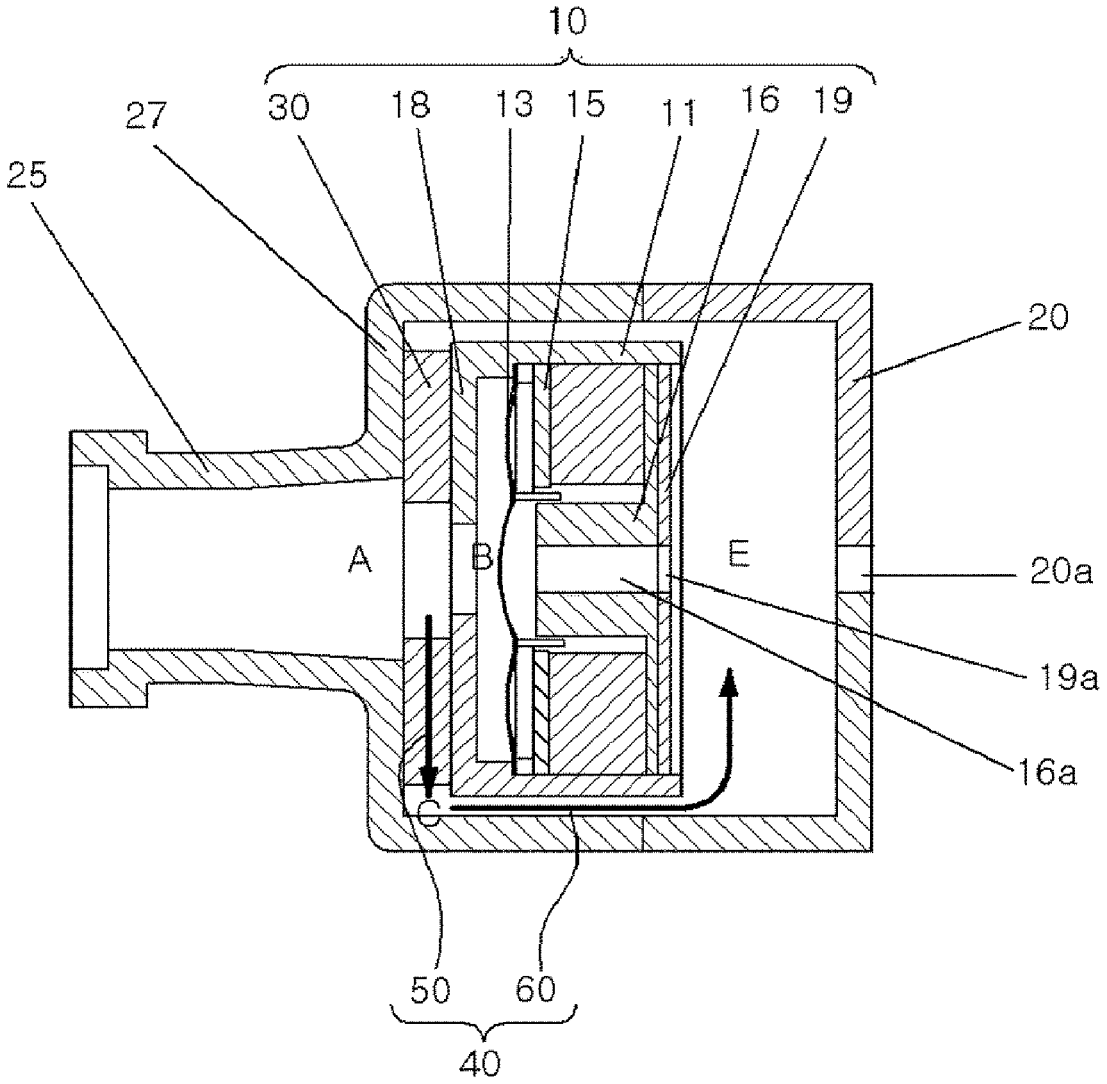
FIG. 7 is a sectional view of a canal-type earphone equipped with a pressure equalizing means according to conventional technology.

As shown in FIG. 6, the balanced armature unit includes: a coil 81 which generates a magnetic field due to current; an armature 82 which is magnetized by the magnetic field generated due to the current which flows along the coil 81; a magnet 83 which generates a magnetic field to interact with the magnetized armature 82; a drive rod 84 which is coupled perpendicular to the armature; and a diaphragm 10 which is vibrated by the drive rod 84 coupled to the armature 82 and generates sound. Furthermore, these components are disposed inside a speaker case 6 including an upper case 61 and a lower case 62.

The speaker case 6 has the same structure as that of the above-described embodiment. Furthermore, a PCB 12 configured such that the lead wire 81*a* of the coil 81 is electrically connected thereto is disposed on the rear surface of the speaker case 6. Furthermore, a ring-shaped gasket 19 is disposed on the front surface of the speaker case 6. The gasket 19 is disposed to surround an outer opening 616 formed in the upper case 61.

Accordingly, when an external electric signal is supplied to the coil 81, a magnetic field is generated in the armature 82 and thus the armature 82 is magnetized. When the armature 82 is magnetized, the armature 82 is vertically vibrated due to interaction with the magnetic field of the magnet 83. In this case, one end of the drive rod 84 is fastened to the armature 82, and thus the drive rod 84 is vibrated along with the armature 82. Furthermore, the diaphragm 10 to which the upper end of the drive rod 84 is attached is vertically vibrated along with the drive rod 84 in response to the movement of the drive rod 84, and thus sound is reproduced.

Furthermore, the sound generated by the diaphragm 10 is emitted into a sound tube 2 through a first air path 50 formed in one side 612*a* of the upper case 61. Furthermore, the sound emitted into the sound tube 2 vibrates a corresponding eardrum of a user through the external ear canal, thereby enabling the user to listen to the sound.

Meanwhile, air present inside the sound tube 2 is introduced into the vibration space 13 of the speaker unit 5 through the first air path 50 formed in the one side 612*a* of the upper case 61. The first air path 50 includes an outer opening 615 formed in one side of the upper case 61 and/or an inner opening 115 formed in one side of a grill 11.

Thereafter, the air introduced into the vibration space 13 of the speaker unit 5 is moved across the vibration space 13 in a horizontal direction, and is then discharged to the outside through a second air path 60 formed in the top surface of the speaker unit 5. In this case, the vibration space 13 of the speaker unit 5 increases the length and width of the air path. In other words, air may be more rapidly discharged by using the vibration space 13.

Furthermore, the air moved to the other side of the vibration space 13 is discharged to the outside through the second air path 60 formed in the other side of the top surface of the speaker unit 5. The second air path 60 includes an outer through hole 616 formed in the other side of the top surface of the upper case 61 and/or an inner through hole 116 formed in the other case of the top surface of the grill 11.

Additionally, when the diaphragm 10 is vertically vibrated, sound pressure generated above the diaphragm 10 is discharged to the outside through the first and second air paths 50 and 60, and sound pressure generated below the diaphragm 10 is discharged to the outside through a through hole 625 formed in the lower case 62. In this case, a screen damper 26 is disposed above the through hole 625 formed in the lower case 62, and may control the amount of air to be discharged.

As described above, the earphone 1 equipped with a pressure equalizing means according to the present invention is configured such that the earphone 1 includes the pressure equalizing means 40 configured to discharge air inside the sound tube 2 of the earphone and air inside the speaker unit out of the speaker unit 5 and thus prevents pressure within the external ear canal from increasing, thereby preventing sound from being heard wrong and also preventing an eardrum from being damaged.

Furthermore, the earphone 1 equipped with a pressure equalizing means according to the present invention is configured such that the speaker unit 5 is disposed inside the earphone housing 3 in a longitudinal direction and the first air path 21 formed to discharge sound, generated by the diaphragm 10 of the speaker unit 5, toward the sound tube 2 is used as a part of the pressure equalizing means 40 configured to discharge air inside the sound tube 2 and air inside the speaker unit 5, thereby simplifying the structure of the pressure equalizing means 40.

Moreover, the present invention is configured such that the second air path 22 is formed to discharge air inside the speaker unit 5 out of the speaker unit 5 and the vibration space 13 between the first air path 21 and the second air path 22 is used as a part of the pressure equalizing means 40, thereby simplifying the structure of the earphone and also enabling air to flow smoothly by increasing the length and width of the air path.

The invention claimed is:

1. An earphone equipped with a pressure equalizing means, the earphone comprising:

an earphone housing in which a sound tube has been formed;

a speaker unit which is disposed inside the earphone housing so that one side thereof is directed toward the sound tube;

an ear tip which is fitted over the sound tube;

a first air path which is formed in one side of the speaker unit, and which is formed to emit sound waves, generated by a diaphragm of the speaker unit, toward the sound tube; and a second air path which is formed in a top surface of the speaker case surrounding the speaker unit, and which is formed to discharge air, inside a vibration space between the speaker case and the diaphragm, out of the speaker unit;

wherein the pressure equalizing means discharges air inside the sound tube out of the speaker unit through the first air path, the vibration space of the speaker unit, and the second air path.

2. The earphone of claim 1, wherein the earphone housing is configured such that the sound tube protrudes from a front surface of the earphone housing, a hollow formed to communicate with the sound tube is formed inside the earphone housing in a front-back direction, a coupling portion having an increased diameter so that the speaker unit is inserted thereinto is formed in a center portion of the hollow, a resonant portion configured to receive the speaker unit is formed behind the hollow, and the resonant portion communicates with an outside air through a through hole formed in a rear end of the earphone housing.

3. The earphone of claim 2, wherein the speaker unit is disposed in the hollow of the earphone housing in a longitudinal direction, and is disposed such that a front end portion thereof is fastened to the coupling portion and a rear end portion thereof is located within the resonant portion.

4. The earphone of claim 3, wherein the speaker unit comprises: a speaker case in which an upper case and a lower case are vertically coupled to each other, and inside which a predetermined space is formed; a magnetic circuit member which comprises a yoke, a magnet, and an upper plate which are disposed inside the speaker case; a fastening ring which is disposed on a top surface of the upper plate; a diaphragm the edge of which is disposed on a top of the fastening ring; and a grill which fastens the edge of the diaphragm.

5. The earphone of claim 4, wherein the yoke comprises a column portion vertically formed at a center of the yoke and provided with a vertical hollow and a flange portion extended outward from a lower end of the column portion by a predetermined length and formed in a rectangular shape so that the yoke is accommodated inside the lower case, the magnet is formed in a rectangular ring shape that is spaced apart from the column portion of the yoke by a predetermined distance, an evasion groove is formed to a predetermined depth through a top surface of the upper plate disposed on a top surface of the magnet so that a lead wire of a voice coil passes through the upper plate, and a seat portion configured to allow a fastening ring to be seated thereon is formed to a predetermined depth along an edge of the top surface of the upper plate.

6. The earphone of claim 4, wherein the first air path comprises an inner opening formed in one side of the grill and an outer opening formed in one side of the upper case to correspond to the inner opening.

7. The earphone of claim 6, wherein the second air path comprises an inner through hole formed in a remaining side of the top surface of the grill and an outer through hole formed in a remaining side of the top surface of the upper case to correspond to the inner through hole.

8. The earphone of claim 7, wherein a screen damper configured to control an amount of air is disposed above the outer through hole of the second air path.

9. The earphone of claim 3, wherein the speaker unit comprises: a speaker case in which an upper case and a lower case are vertically coupled to each other, and inside which a predetermined space is formed; a coil which is disposed inside the speaker case, and which generates a magnetic field due to current; an armature which is magnetized by the magnetic field generated due to the current which flows along the coil; a magnet which generates a magnetic field to interact with the magnetized armature; a drive rod which is coupled perpendicular to the armature; and a diaphragm which is vibrated by the drive rod coupled to the armature and generates sound.

10. The earphone of claim 9, wherein the first air path comprises an outer opening formed in one side of the upper case to correspond to the inner opening, the second air path comprises an outer through hole formed in a remaining side of the top surface of the upper case to correspond to the inner through hole, and the first air path and the second air path communicate with each other through the vibration space formed between the upper case and the diaphragm.

* * * * *